US008220297B2

(12) United States Patent
Palumbo et al.

(10) Patent No.: US 8,220,297 B2
(45) Date of Patent: Jul. 17, 2012

(54) PAPER TRAY LOCKING APPARATUS

(75) Inventors: Thomas C Palumbo, Rochester, NY (US); Charles R Brewer, III, Farmington, NY (US); George P Powers, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 583 days.

(21) Appl. No.: 12/256,488

(22) Filed: Oct. 23, 2008

(65) Prior Publication Data

US 2010/0102503 A1 Apr. 29, 2010

(51) Int. Cl.
*B65H 1/00* (2006.01)

(52) U.S. Cl. ..... 70/57; 70/2; 70/14; 70/80; 70/58; 70/79

(58) Field of Classification Search ..... 70/2, 14, 70/57, 58, 78, 79, 80
See application file for complete search history.

(56) References Cited

U.S. PATENT DOCUMENTS

| | | | | |
|---|---|---|---|---|
| 5,268,809 | A * | 12/1993 | Eschenburg | 360/137 |
| 5,406,809 | A * | 4/1995 | Igelmund | 70/2 |
| 5,802,887 | A * | 9/1998 | Beland | 70/14 |
| 6,735,989 | B1 * | 5/2004 | Schramm et al. | 70/2 |
| 7,753,356 | B2 * | 7/2010 | Rowe et al. | 271/9.11 |

FOREIGN PATENT DOCUMENTS

| | | | |
|---|---|---|---|
| JP | 07267482 | A * | 10/1995 |
| JP | 2007112583 | A * | 5/2007 |

* cited by examiner

*Primary Examiner* — Suzanne Barrett
*Assistant Examiner* — Ifeolu Abeboyejo

(57) ABSTRACT

A low cost locking device for securing special forms in paper trays when a printer is unattended that can be easily be field installed without screws or other fasteners or tools includes a bracket tray lock, a tray lock plate assembly and a padlock that cooperate to prevent the paper trays from being removed from the printer without a key for the padlock.

6 Claims, 6 Drawing Sheets

PAPER TRAY LOCKING APPARATUS

This invention relates in general to an image forming apparatus, and more particularly, to an image forming apparatus employing a paper tray locking apparatus.

Currently, there is no means of securing the paper tray of an image forming apparatus or printer when non-public forms, such as, prescriptions, bank drafts, etc. are loaded for printing. This is true whether single or multiple sheet feed trays are employed.

In a typical printer apparatus, as for example, the Xerox 4510®, printing is an operation in which a toner image is formed with an image forming unit based on image data and is transferred and conveyed to a fuser to fuse the toner image onto paper at the fuser. Subsequently, the fused image on the paper is conveyed out of the printer to an output station.

It is necessary with the above-mentioned printer, however, to have an operator monitor the printer when special forms, such as, prescription blanks and check blanks are to remain loaded in the printer. This procedure is labor intensive and costly.

Accordingly, disclosed is a clever, simple, low cost and effective design adapted to solve the above-mentioned problems in a conventional printer and to provide an image forming apparatus that facilitates security of non-monitored special forms in the printer that includes a media tray locking arrangement used when the reprographic device is unattended. The locking arrangement includes a bracket tray lock mechanism, a tray lock plate assembly and a lock mechanism.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
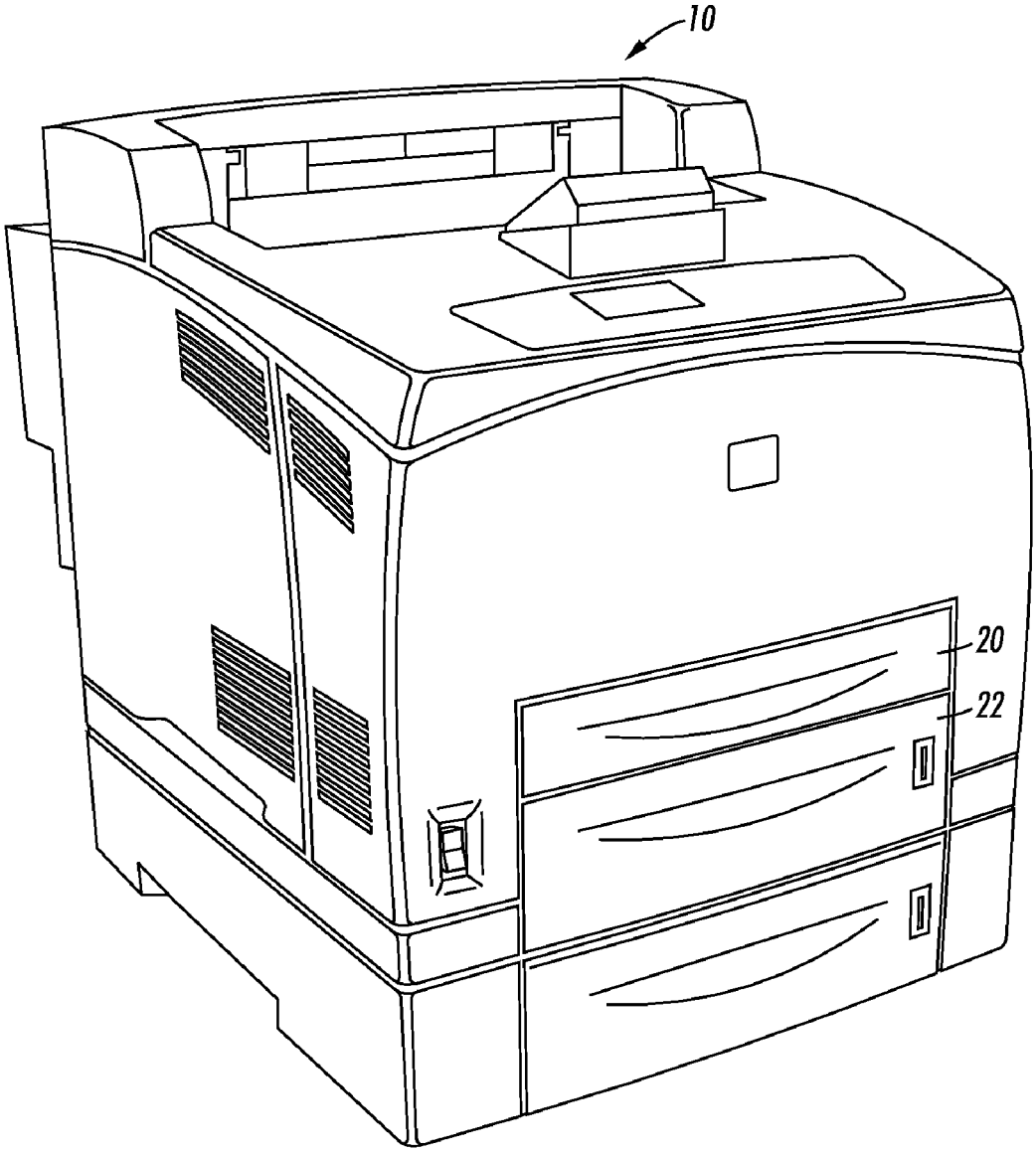
FIG. 1 is a schematic showing a conventional printer with two sheet feeding trays.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved finishing system.

For a general understanding of the features of the disclosure, reference is made to the drawings. In the drawings, like reference numerals have been used throughout to identify identical elements.

Referring to the FIG. 1 printer 10, as in other xerographic machines, as is well known, an electronic document or an electronic or optical image of an original document or set of documents to be reproduced may be projected or scanned onto a charged surface or a photoreceptor belt to form an electrostatic latent image. The latent image is developed with developing material to form a toner image corresponding to the latent image. The toned image is then electrostatically transferred to a final print media material, such as, paper sheets, to which it may be permanently fixed by a fusing device. After separating from a fuser roll in the fuser device, the paper sheets are free to move along a predetermined path toward the exit of the printer 10.

Final print media material is placed into media trays 20 and 22 and either tray can be used to feed media therefrom to have images placed thereon. It is sometimes highly desirable to provide a locking capability that is not currently available when special forms, such as, prescription blanks or check blanks are to remain in the printer for an extended period of time or when an operator is away from the machine.

Figure 2:
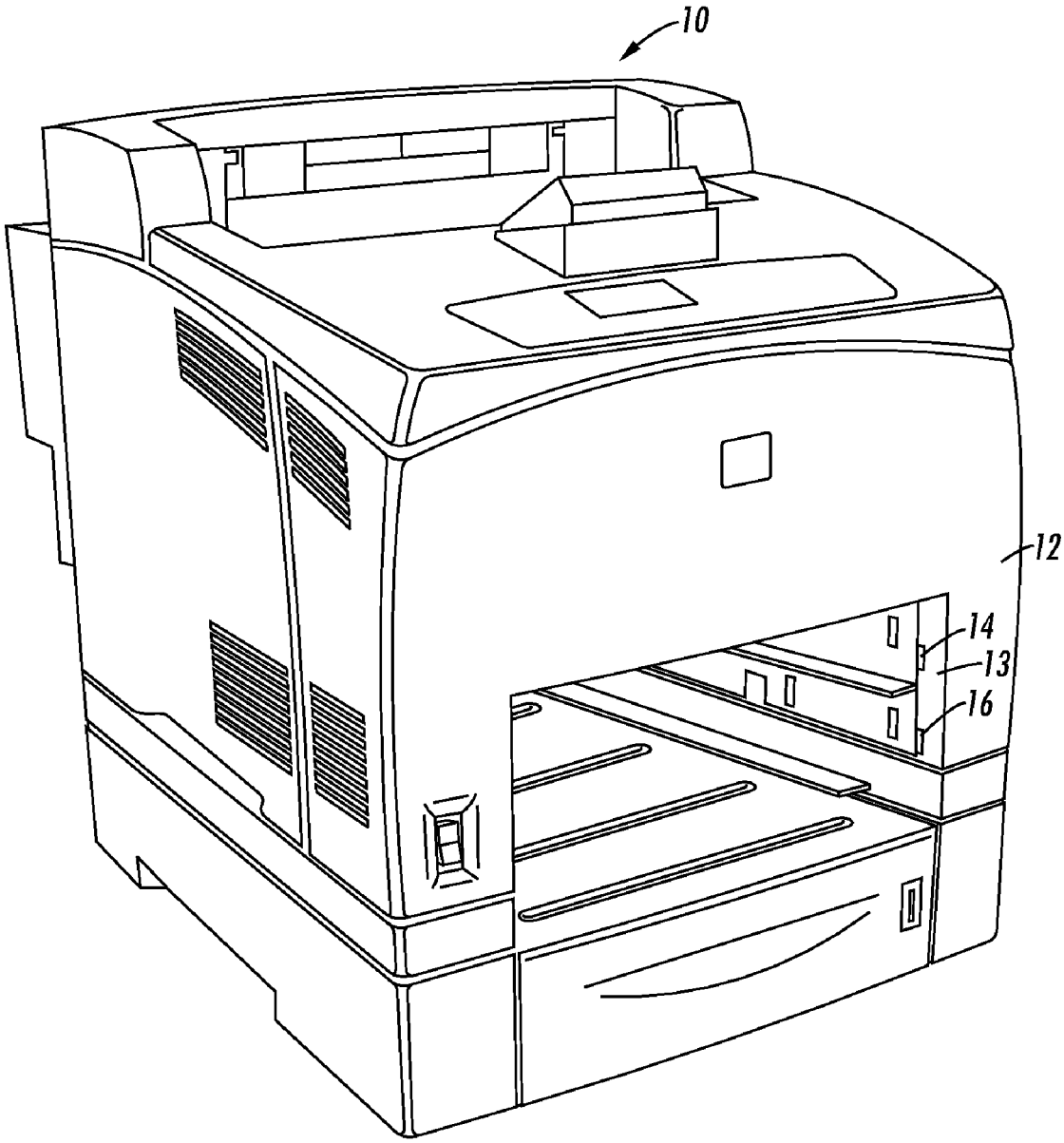
FIG. 2 is a schematic perspective of the printer of FIG. 1 with multiple paper trays removed.
Figure 3:
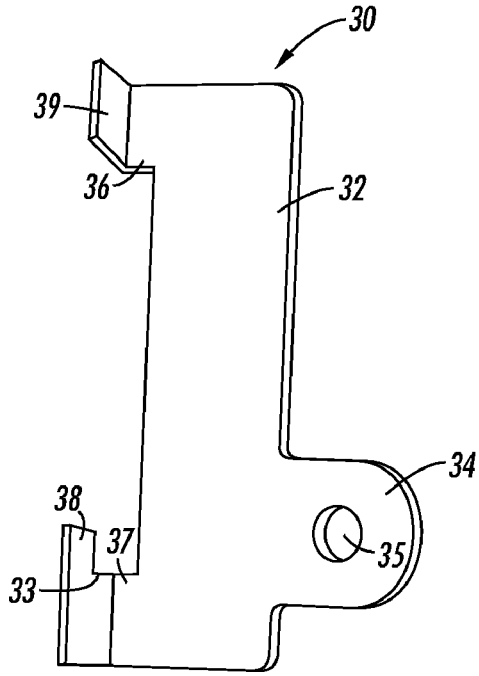
FIG. 3 is a plan view of a bracket tray lock mechanism.

In accordance with the present disclosure, a simple, low cost, securing arrangement to provide security for forms left unattended in media trays 20 and 22 is shown in FIGS. 2-8. In FIG. 2, printer 10 is shown with media trays 20 and 22 removed. A Frame portion 12 of printer 10 has opening 14 and 16 in a wall portion 13 thereof. A bracket tray locking mechanism 30 in FIG. 3 includes a flat rectangular portion 32 and a flat member 34 extending outwardly therefrom and in the same plane of rectangular portion 32 in a first direction with flat member 34 including an opening 35 therein. Also, extending in a second direction away from and in the same plane of rectangular portion 32 are flat members 36 and 37. Flat members 36 and 37 include orthogonal tabs members 38 and 39. Tab member 38 also includes a notched portion 33 therein.

Figure 4:
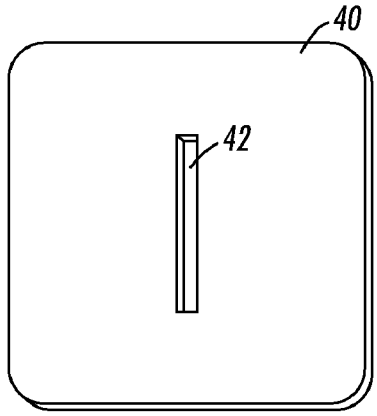
FIG. 4 is a plan view of a tray lock plate assembly.

As shown in FIG. 4, and in accordance with the present disclosure, a tray lock plate assembly 40 is included for mating with bracket tray locking mechanism 30. Tray lock plate assembly 40 includes a slit 42 therein that is adapted to fit over flat member 34 of bracket tray locking mechanism 30.

Figure 5:
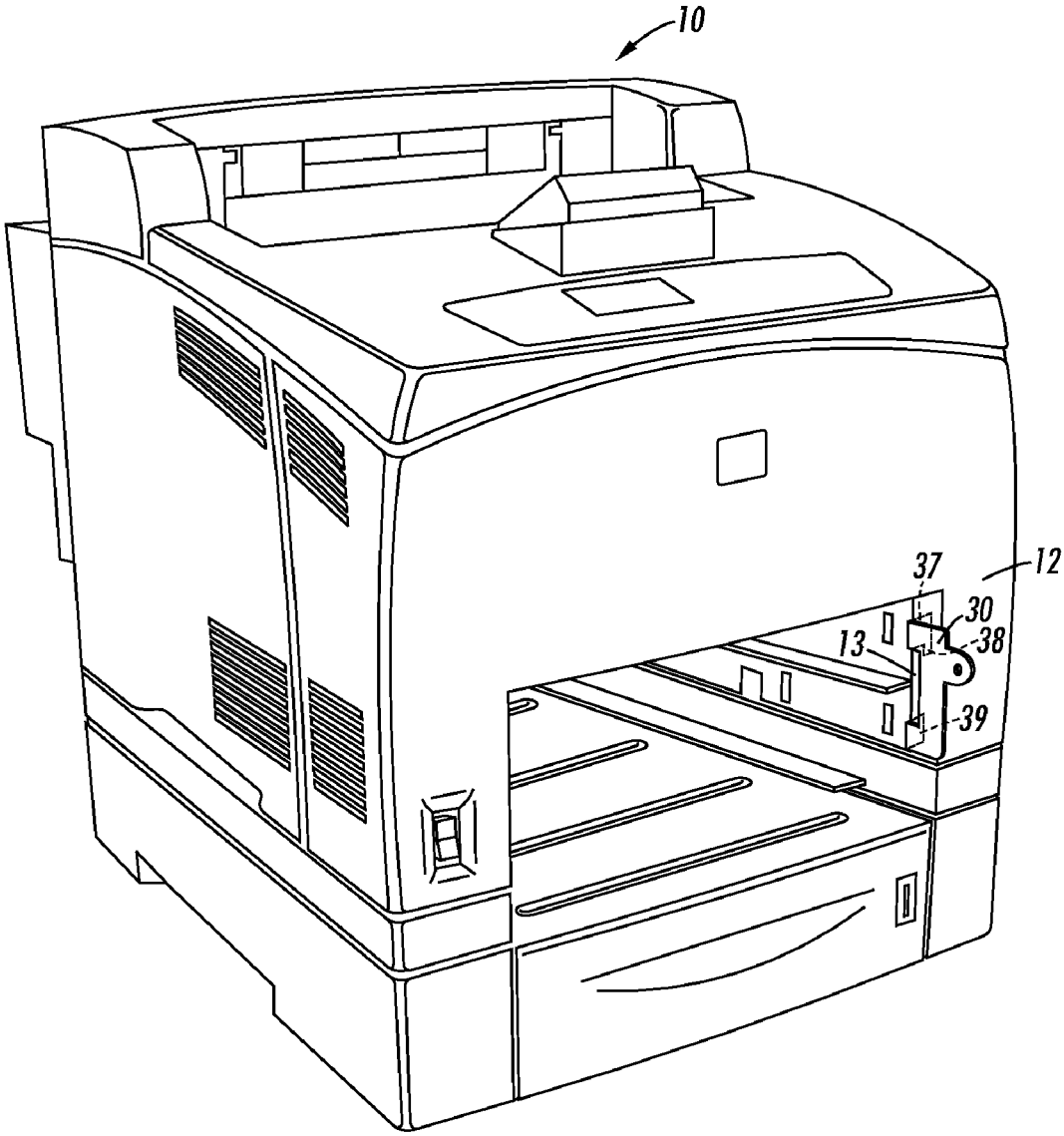
FIG. 5 is a partial schematic of the printer of FIG. 1 with the bracket tray lock mechanism of FIG. 3 in place.
Figure 6:
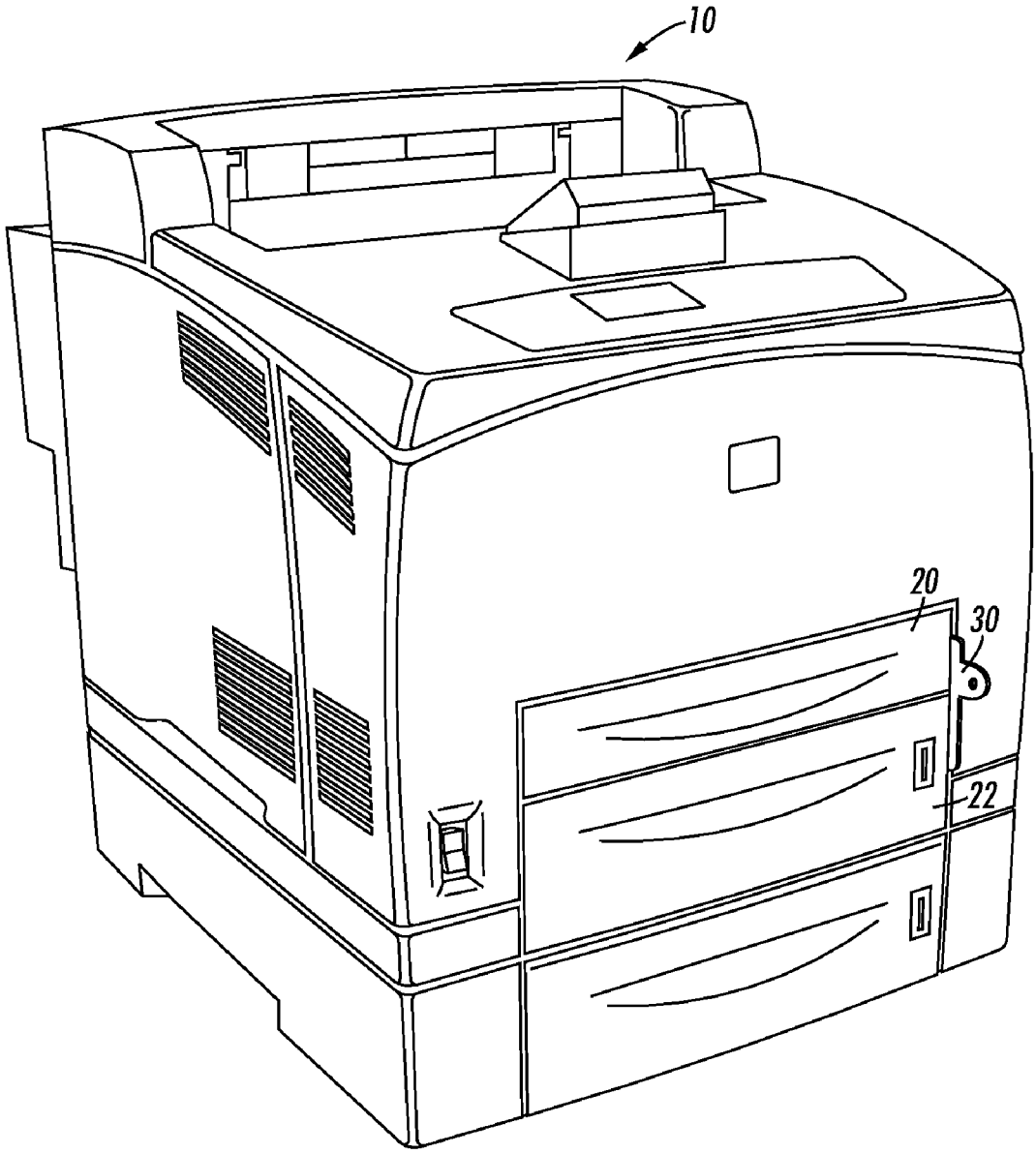
FIG. 6 is a schematic of the printer of FIG. 5 showing multiple paper trays installed in the printer of FIG. 1 with a tray lock plate assembly installed.
Figure 7:
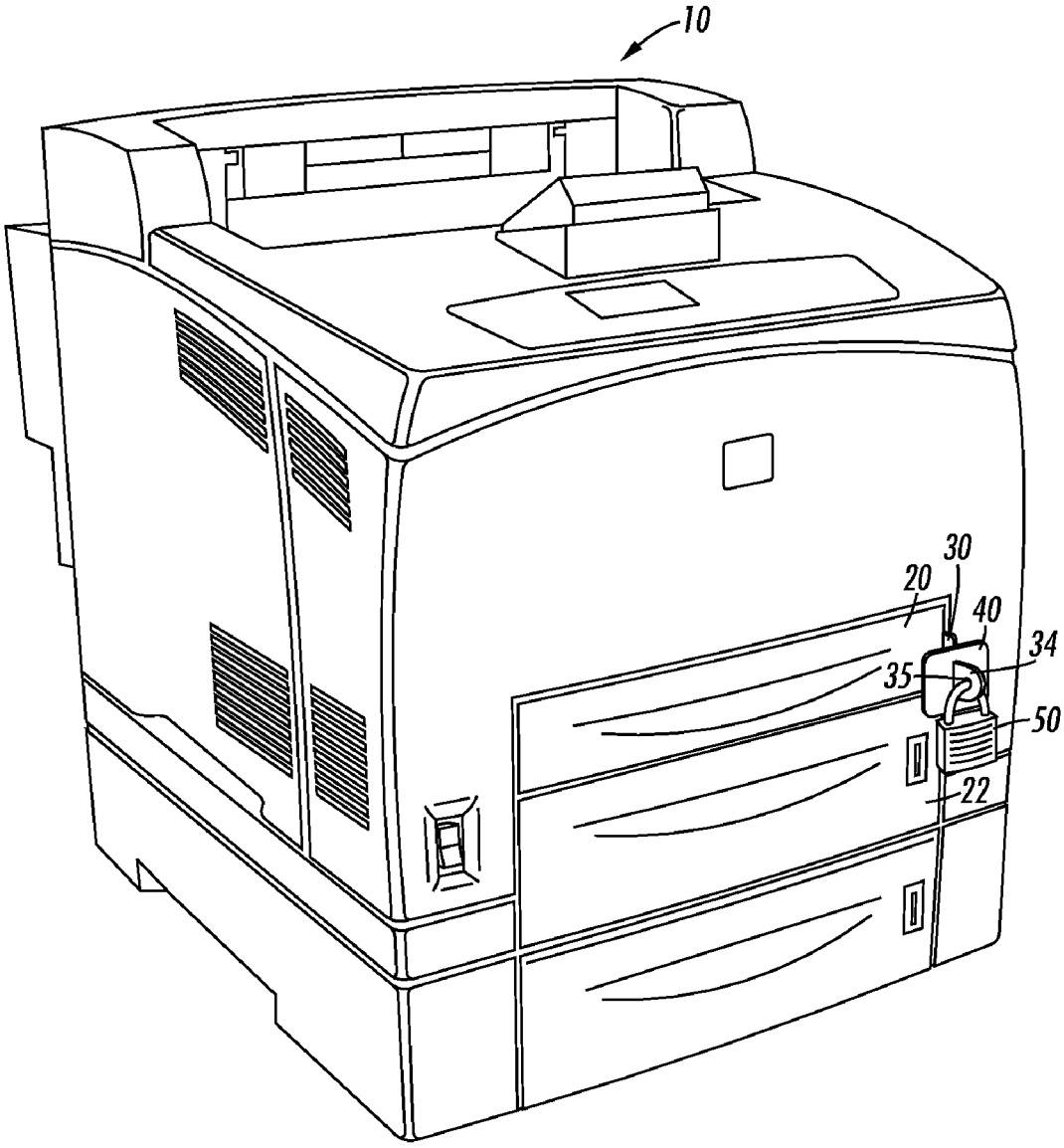
FIG. 7 is a schematic of the printer of FIG. 6 with a padlock installed.

In use, with media trays 20 and 22 removed, bracket tray locking mechanism 30 is connected to frame portion 12 of printer 10 with orthogonal tab members 37 and 39 fitted into openings 14 and 16, respectively, of wall portion 13 of printer 10 as shown in FIG. 5. Notched portion 33 of orthogonal tab member 38 allows bracket tray locking mechanism 30 to slide downward within openings 14 and 16 to the extent of the notched portion 33 and lock in place. Media trays 20 and 22 are then inserted into the printer with the bracket locking mechanism 30 in place as shown in FIG. 6. Afterwards, tray lock plate assembly 40 is placed over flat member 34 of bracket locking mechanism 30 to an extent that opening 35 in bracket locking mechanism 30 is exposed. Then media trays 20 and 22 are secured by inserting an arm of padlock 50 through opening 35 and locking the padlock as shown in FIG. 7.

It should now be understood that a low cost locking device has been disclosed for securing special forms in paper trays when a printer is unattended. The device can be easily field installed without screws or other fasteners or tools and includes a bracket tray lock, a tray lock plate assembly and a padlock.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device, comprising:

an image processor that receives image data from a source and processes it;

a frame portion of said reprographic device configured for supporting media feed trays, said frame portion including a vertical side portion thereof that includes a pair of openings therein;

a plurality of media feed trays adapted to fit within said housing portion and feed media to receive images thereon from said image processor; and a media tray locking arrangement for securing media within said media feed trays when said reprographic device is unattended, said media tray locking arrangement including a bracket having a flat portion and a flat member having a hole therein and extending outwardly therefrom and in the same plane as said flat portion in a first direction, and wherein said flat portion includes a first pair of flat members extending in a second and opposite direction away from and in the same plane as said flat portion, and wherein said flat portion includes a second pair of flat members extending orthogonally with respect to said first pair of flat members, and wherein one of said second pair of flat members includes a notch portion therein, and wherein said notch portion facilitates the sliding of said bracket downward within said pair of openings to the extent of said notch portion and lock in place within said vertical side portion of said housing portion.

2. The reprographic device of claim 1, wherein said second pair of flat members are adapted to fit within said pair of openings.

3. The reprographic device of claim 2, wherein said plurality of media trays are adapted to be inserted into said frame portion after said bracket is secured within said vertical side portion of said frame portion.

4. The reprographic device of claim 3, wherein said media tray locking arrangement includes a tray lock plate having a slit therein and adapted to fit over said outwardly extending portion of said flat member while simultaneously exposing said hole in said outwardly extending portion of said flat member.

5. The reprographic device of claim 4, wherein said media tray locking arrangement includes a lock mechanism with a portion thereof extending through said opening in said outwardly extending portion of said flat member.

6. The reprographic device of claim 2, wherein said bracket is positioned immediately adjacent said vertical side portion of said frame portion that includes said pair of openings therein.

* * * * *